US009749731B2

(12) United States Patent
Yeo

(10) Patent No.: US 9,749,731 B2
(45) Date of Patent: Aug. 29, 2017

(54) SIDETONE GENERATION USING MULTIPLE MICROPHONES

(71) Applicant: Bose Corporation, Framingham, MA (US)

(72) Inventor: Xiang-Ern Yeo, Brighton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/003,339

(22) Filed: Jan. 21, 2016

(65) Prior Publication Data

US 2017/0214996 A1 Jul. 27, 2017

(51) Int. Cl.

*H04R 3/00* (2006.01)
*H04R 1/10* (2006.01)
*H04R 3/04* (2006.01)

(52) U.S. Cl.

CPC ..... *H04R 1/1041* (2013.01); *H04R 1/1016* (2013.01); *H04R 3/005* (2013.01); *H04R 3/04* (2013.01); *H04R 2430/20* (2013.01); *H04R 2460/05* (2013.01)

(58) Field of Classification Search

CPC ..... H04R 1/1041; H04R 3/04; H04R 1/1016; H04R 3/005; H04R 2460/05; H04R 2430/20

See application file for complete search history.

(56) References Cited

U.S. PATENT DOCUMENTS 8,620,650 B2 12/2013 Walters et al.
2010/0022280 A1* 1/2010 Schrage ..... H04M 1/58 455/567
2010/0272284 A1* 10/2010 Joho ..... G10K 11/178 381/71.8
2014/0294193 A1* 10/2014 Tikander ..... H04R 3/02 381/74
2015/0256660 A1* 9/2015 Kaller ..... H04M 1/585 379/391
2015/0364145 A1 12/2015 Keller et al.

* cited by examiner

*Primary Examiner* — Muhammad N Edun
(74) *Attorney, Agent, or Firm* — Fish & Richardson P.C.

(57) ABSTRACT

The technology described in this document can be embodied in an apparatus that includes an input device, a sidetone generator, and an acoustic transducer. The input device includes a set of two or more microphones, and is configured to produce digitized samples of sound captured by the set of two or more microphones. The sidetone generator includes one or more processing devices, and is configured to receive digitized samples that include at least one digitized sample for each of two or more microphones of the set. The sidetone generator is also configured to process the received digitized samples to generate a sidetone signal. The acoustic transducer is configured to generate an audio feedback based on the sidetone signal.

19 Claims, 3 Drawing Sheets

SIDETONE GENERATION USING MULTIPLE MICROPHONES

TECHNICAL FIELD

This disclosure generally relates to headsets used for communications over a telecommunication system.

BACKGROUND

Headsets used for communicating over telecommunication systems include one or more microphones and speakers. The speaker portion of such a headset can be enclosed in a housing that may cover a portion of one or both ears of the user, thereby interfering with the user's ability to hear his/her own voice during a conversation. This in turn can cause the conversation to sound unnatural to the user, and degrade the quality of user-experience of using the headset.

SUMMARY

In one aspect, this document features an apparatus that includes an input device, a sidetone generator, and an acoustic transducer. The input device includes a set of two or more microphones, and is configured to produce digitized samples of sound captured by the set of two or more microphones. The sidetone generator includes one or more processing devices, and is configured to receive digitized samples that include at least one digitized sample for each of two or more microphones of the set. The sidetone generator is also configured to process the received digitized samples to generate a sidetone signal. The acoustic transducer is configured to generate an audio feedback based on the sidetone signal.

In another aspect, this document features a method that includes generating digitized samples of sound captured by a set of two or more microphones, and receiving, at one or more processing devices, digitized samples that include at least one digitized sample for each of two or more microphones of the set. The method also includes processing the digitized samples to generate a sidetone signal, and generating audio feedback based on the sidetone signal.

In another aspect, this document features or more non-transitory machine-readable storage devices that store instructions executable by one or more processing devices to perform various operations. The operations include receiving digitized samples that include at least one digitized sample from each of two or more microphones of a set of microphones generating digitized samples of captured sound. The operations also include processing the digitized samples to generate a sidetone signal, and causing generation of audio feedback based on the sidetone signal.

Implementations of the above aspects can include one or more of the following features.

One or more frames of the digitized samples of the sound captured by the set of two or more microphones can be buffered in a memory. The one or more frames of the digitized samples can be processed by a circuitry for subsequent transmission. The sidetone generator can be configured to generate the sidetone signal in parallel with the buffering of the one or more frames of the digitized samples. The sidetone generator can be configured to process the received digitized samples based on one or more parameters provided by the circuitry for processing the one or more frames of the digitized samples. The one or more processing devices can be configured to receive a set of multiple digitized samples for each of the two or more microphones of the set to generate the sidetone signal. A number of digitized samples in each set of multiple digitized samples can be based on a target latency associated with generating the sidetone signal. Processing the received digitized samples can include executing a beamforming operation using samples from the set of two or more microphones. Processing the received digitized samples can include executing a microphone mixing operation using samples from the set of two or more microphones. Processing the received digitized samples can include executing an equalization operation. The sidetone generator can be configured to generate the sidetone signal within 5 ms of receiving the at least one digitized sample for each of two or more microphones of the set.

Various implementations described herein may provide one or more of the following advantages.

Using multiple microphones for generating sidetone signals can allow for implementing signal conditioning processes such as beamforming and mic-mixing, which may in turn reduce noise content of the sidetone signal and improve user experience. Stream based processing can be used to process a small number of samples at a time to improve sidetone signals via techniques typically associated with frame-based processing of outgoing signals, while reducing latencies associated with buffering of frames of samples employed in such frame-based processing. Using the techniques described herein, in some cases, a significant amount of the user's own voice may be played back to the user via the headset speakers, while reducing background noise.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

Figure 1:
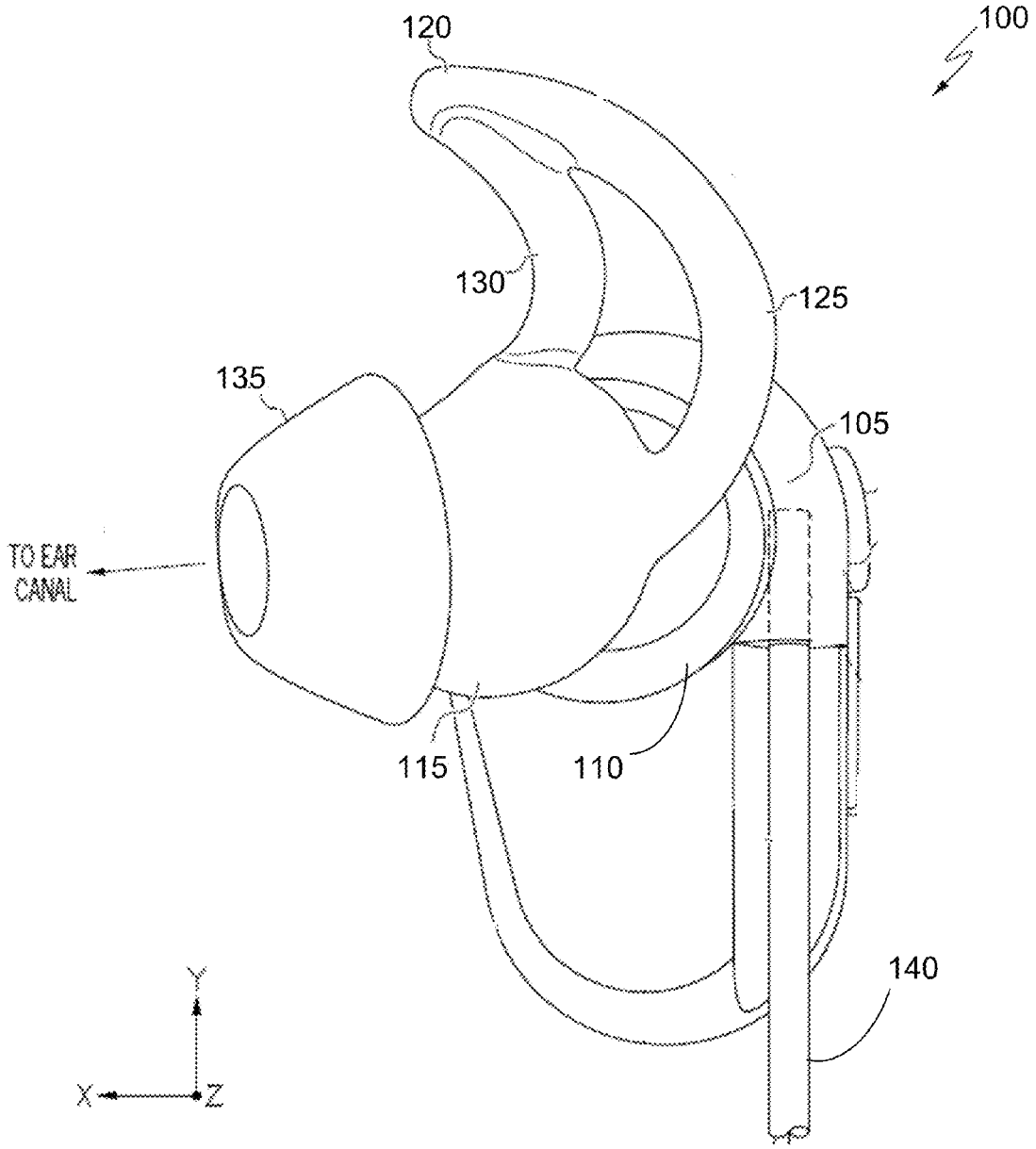
FIG. 1 is an example of a headset.

Sidetone generation is used for providing an audible feedback to a user of a communication headset that interferes with the user's ability to hear ambient sounds naturally. Naturalness of a conversation can be improved, for example, by detecting the user's own voice using a microphone, and playing it back as an audible feedback via a speaker of the communication headset. Such audible feedback is referred to as a sidetone. The term "communication headset" or "headset," as used in this document, includes various acoustic devices where at least a portion of the user's ear (or ears) is covered by the corresponding device, thereby affecting the user's natural ability to hear ambient sounds, including his/her own voice. Such acoustic devices can include, for example, wired or wireless-enabled headsets, headphones, earphones, earbuds, hearing aids, or other in-ear, on-ear, or around-ear acoustic devices. In the absence of a sidetone generator in a headset, a user may not be able to hear ambient sounds, including his/her own voice while speaking, and therefore may find the experience to be unnatural or uncomfortable. This in turn can degrade the user experience associated with using headsets for conversations or announcements.

A sidetone generator may be used in a communication headset to restore, at least partially, the natural acoustic feeling of a conversation. A sidetone generator can be used, for example, to provide to the user, through a speaker, acoustic feedback based on the user's own voice captured by a microphone. This may allow the user to hear his/her own voice even when the user's ear is at least partially covered by the headset, thereby making the conversation sound more natural to the user.

The naturalness of the conversation may depend on the quality of the sidetone signal used for generating the acoustic feedback provided to the user. In some cases, the sidetone signal can be based on samples from a single microphone of the headset. However, because directional processing is typically not possible with samples from a single microphone, a resulting acoustic feedback may contain a high amount of noise. This may result in an undesirable user-experience in some cases, for example, when the headset is used in a noisy environment. While headsets with multiple microphones may use noise reduction and/or signal enhancing processes such as directive beamforming and microphone mixing (e.g., normalized least mean squares (NLMS) Mic Mixing), such processes typically require buffering of one or more frames of signal samples, which in turn can make the associated latencies unacceptable for sidetone generation. For example, buffering used in a frame-based architecture or circuit of a headset may result in a latency of 7.5 ms or more, which is greater than the standard of 5 ms prescribed by the telecommunication standardization sector of the International Telegraph Union (ITU-T). In some cases, any sidetone generated using such a frame-based circuit may produce undesired acoustic effects such as echoes and reverberations, making the sidetone subjectively unacceptable to the user. For these reasons, frame-based processes are usually used for processing outgoing signals sent out from the headset, and not for sidetone generation.

The technology described herein facilitates implementing noise reduction and/or signal enhancing processes such as directive beamforming and microphone mixing using a sidetone generator that employs a low-latency stream-based architecture. Such a sidetone generator can be configured to process input data provided by multiple microphones, using a small number of samples from each microphone to enable low latency (e.g., 3-4 ms) processing. The number of samples per microphone can be one, two, three, or a suitable number selected based on a target latency. For example, a higher number of samples may provide better frequency resolution at the cost of an increased latency, and a lower number of samples may reduce latency at the cost of lower frequency resolution. In some implementations, the number of samples per microphone can be selected to be lower than the number of samples buffered for the frame-based processing by the outgoing signal processor. In some implementations, the target latency can be based on, for example, a standard (e.g., the standard of 5 ms prescribed by ITU-T) or a limit over which undesirable acoustic effects such as echoes or reverberation may be perceived by a human user.

The low latency processing may result in a noise-reduced sidetone that reduces the undesirable acoustic effects such as reverberation or echoes. This in turn can enable the sidetone generator to produce high quality sidetones, possibly at real-time or near real-time, even in noisy environments. In some implementations, the sidetone generator can be configured to process samples from the multiple microphones in parallel with the operations of frame-based circuit or architecture that processes the data sent out from the headset. In some implementations, the sidetone generator may function in conjunction with the frame-based circuit, for example, to obtain one or more parameter values that are calculated by the frame-based circuit, but are also usable by the sidetone generator. In some cases, this may reduce processing load on the sidetone generator.

FIG. 1 shows an example of a headset 100. While an in-ear headset is shown in the example, other acoustic devices such as wired or wireless-enabled headsets, headphones, earphones, earbuds, hearing aids, or other in-ear, on-ear, or around-ear acoustic devices are also within the scope of the technology described herein. The example headset 100 includes an electronics module 105, an acoustic driver module 110, and an ear interface 115 that fits into the wearer's ear to retain the headset and couple the acoustic output of the driver module 110 to the user's ear canal. In the example headset of FIG. 1, the ear interface 115 includes an extension 120 that fits into the upper part of the wearer's concha to help retain the headset. In some implementations, the extension 120 can include an outer arm or loop 125 and an inner arm or loop 130 configured to allow the extension 120 to engage with the concha. In some implementations, the ear interface 115 may also include an ear-tip 135 for forming a sealing configuration between the ear interface and the opening of the ear canal of the user.

In some implementations, the headset 100 can be configured to connect to another device such as a phone, media player, or transceiver device via one or more connecting wires or cables (e.g., the cable 140 shown in FIG. 1). In some implementations, the headset may be wireless, e.g., there may be no wire or cable that mechanically or electronically couples the earpiece to any other device. In such cases, the headset can include a wireless transceiver module capable of communicating with another device such as a mobile phone or transceiver device using, for example, a media access control (MAC) protocol such as Bluetooth®, IEEE 802.11, or another local area network (LAN) or personal area network (PAN) protocol.

Figure 2:
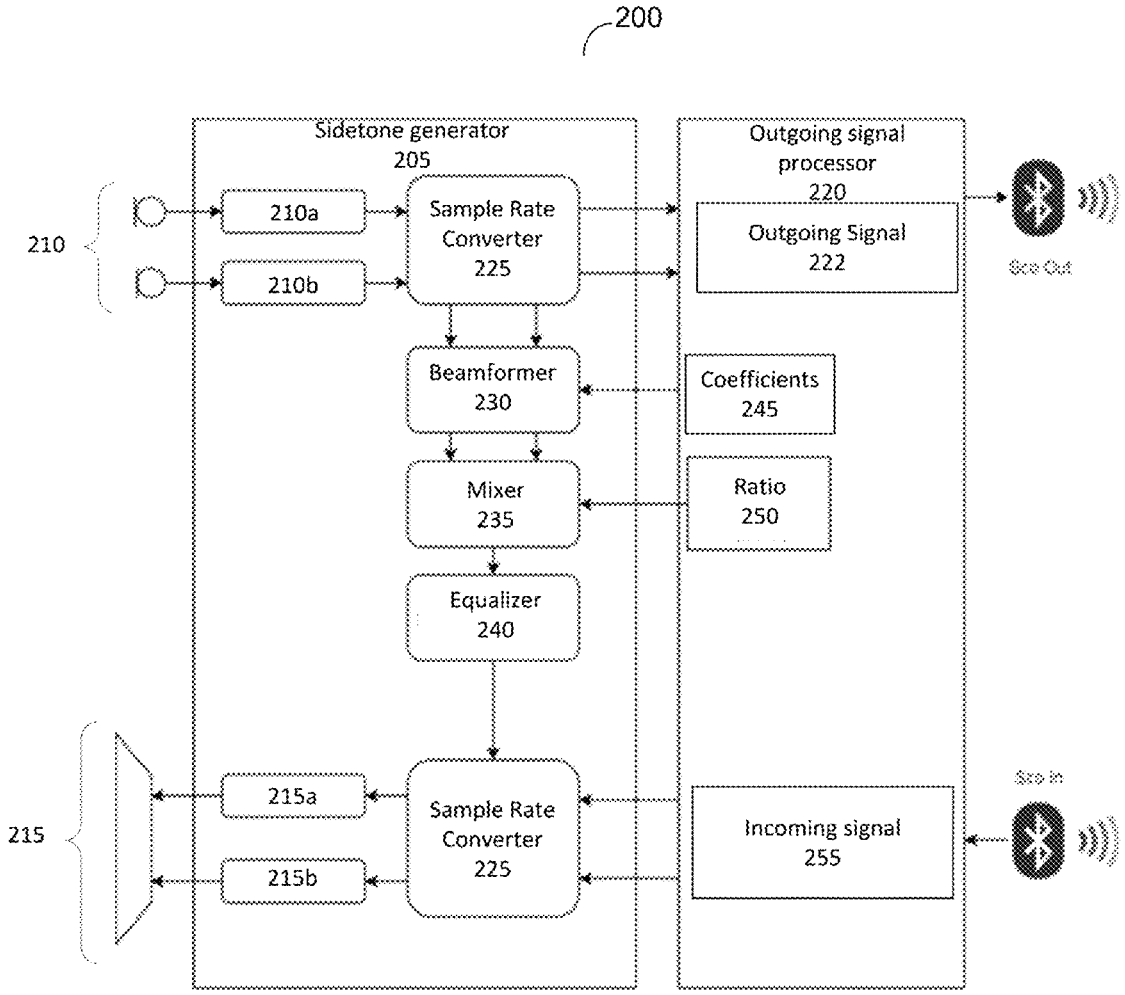
FIG. 2 is a schematic diagram illustrating signal paths in one example implementation of the technology described herein.

In some implementations, the headset 100 includes multiple microphones that capture the voice of a user and/or other ambient acoustic components such as noise, and produce corresponding electronic input signals. The headset 100 can also include circuitry for processing the input signals for subsequent transmission out of the headset, and for generating sidetone signals based on the input signals. FIG. 2 is a schematic diagram illustrating signal paths within such circuitry 200 in one example implementation of the technology described herein. In some implementations, the circuitry 200 includes a sidetone generator 205 that generates a sidetone based on input signals provided by multiple microphones 210*a*, 210*b* (210, in general). Even though the example of FIG. 2 shows two microphones 210*a* and 210*b*, more than two microphones (e.g., three, four or five microphones) may be used without deviating from the scope of the technology described herein. The sidetone signals generated by the sidetone generator 205 may be used to produce acoustic feedback via one or more acoustic transducers or speakers 215*a*, 215*b* (215, in general). Even though the example of FIG. 2 shows two speakers 215*a* and 215*b*, fewer or more speakers may also be used.

The circuitry 200 can also include an outgoing signal processor 220 that processes the input signals provided by the multiple microphones 210 to generate outgoing signals 222 that are transmitted out of the headset. The outgoing signal processor 220 may include a frame-based architecture that processes frames of input samples buffered in a memory device (e.g., one or more registers). Such frame-based processing may allow for implementation of advanced signal conditioning processes (e.g., beamforming and microphone mixing) that improve the outgoing signal 222 and/or reduce noise in the outgoing signal 222. However, the buffering process associated with such frame-based processing introduces some latency that may be unacceptable for generating sidetones. Therefore, in some implementations, the sidetone generator 205 can be configured to process samples of the input signals provided by the microphones 210 in parallel with the operations of an outgoing signal processor 220 to generate sidetone signals at a lower latency than that associated with the outgoing signal processor 220.

The circuitry 200 may include one or more analog to digital converters (ADC) that digitize the analog signals captured by the microphones 210. In some implementations, the circuitry 200 includes a sample rate converter 225 that converts the sample rate of the digitized signals to an appropriate rate as required for the corresponding application (e.g., telephony). The output of the sample rate converter 225 can be provided to the outgoing signal processor 220, where the samples are buffered in preparation of being processed by the frame-based architecture of the outgoing signal processor 220. In some implementations, outputs of the sample rate converter 225 are also provided to circuitry within the sidetone generator 205, where a small number of samples from each microphone are processed to generate the sidetone signals.

In some implementations, the sidetone generator 205 can be configured to generate a sidetone signal based on a subset of the samples that are buffered for subsequent processing by the outgoing signal processor 220. For example, the sidetone generator 205 can be configured to generate a sidetone signal based on one sample each from a set of microphones 210. Therefore, the sidetone signal can be generated multiple times as the samples from the microphones are buffered in the outgoing signal processor 220. For example, a sidetone signal can be produced every 3 milliseconds or less. Such fast processing allows for the sidetones to be generated at real-time or near real-time, e.g., with latency that is not high enough for a human ear to perceive any noticeable undesirable acoustic effects such as echoes or reverberations. In some implementations, more than one sample from each microphone 210 may be processed to improve the quality of processing by the sidetone generator. However, processing multiple samples may entail a higher latency, as well as more complexity of the associated processing circuitry. Therefore, the number of input samples that are processed to generate the sidetone signal can be selected based on various design constraints such as latency, processing goal, available processing power, complexity of associated circuitry, and/or cost. In some implementations, samples from only a subset of the microphones may be used in generating the sidetone. In one example, even though samples from three or four microphones may be used by the outgoing signal processor 220, the sidetone generator 205 may use samples from only two microphones to generate the sidetones.

The sidetone generator 205 can be configured to use various types of processing in generating the sidetone signal. In the example of FIG. 2, the sidetone generator includes a beamformer 230, a microphone mixer 235, and an equalizer 240. However, fewer or more processing modules may also be used. In addition, even though FIG. 2 shows the beamformer 230, mixer 235, and equalizer 240 to be connected in series, portions of the associated processing may be done in parallel to one another, or in a different order.

The beamformer 230 can be configured to combine signals from two or more of the microphones to facilitate directional reception. This can be done using a spatial filtering process that processes the signals from the microphones that are arranged as a set of phased sensor arrays. The signals from the various microphones are combined in such a way that signals at particular angles experience constructive interference while signals at other angles experience destructive interference. This allows for spatial selectivity to reduce the effect of any undesired signal (e.g., noise) coming from a particular direction. In some implementations, the beamforming can be implemented as an adaptive process that detects and estimates the signal-of-interest at the output of a sensor array, for example, using spatial filtering and interference rejection. Various types of beamforming techniques can be used by the beamformer 230. In some implementations, the beamformer 230 may use a time-domain beamforming technique such as delay-and-sum beamforming. In other implementations, frequency domain techniques such as a minimum variance distortionless response (MVDR) beamformer may be used for estimating direction of arrival (DOA) of signals of interest.

In some implementations, the directional signal generated by the beamformer 230 is passed to a mixer 235 together with an omni-directional signal (e.g., the sum of the signals received by the microphones, without any directional processing). The mixer 235 can be configured to combine the signals, for example, to increase (e.g., to maximize) the signal to noise ratio in the output signal. Various types of mixing processes can be used for combining the signals. In some implementations, the mixer 235 can be configured to use a least mean square (LMS) filter such as a normalized LMS (NLMS) filter to combine the directional and omni-directional signals. The associated mixing ratio may be represented as $\alpha$, and can be used to weight the omni-directional signal p(n) and the directional beamformed signal v(n) as follows:

$$y(n)=\alpha*p(n)+(1-\alpha)*v(n) \quad (1)$$

In some implementations, the mixing ratio $\alpha$ can be dynamically calculated by the sidetone generator 205 via an NLMS process.

In some implementations, one or more parameters used by the sidetone generator 205 can be obtained from the outgoing signal processor 220, for example, to reduce the computational burden on the sidetone generator 205. This may increase the speed of processing of the sidetone generator 205 thereby allowing faster generation of the sidetones. In one example, the beamforming coefficients 245 used by the beamformer 230 may be obtained from the outgoing signal processor 220. In another example, the ratio (a) 250 may also be obtained from the outgoing signal processor 220. Such cooperation between the sidetone generator 205 and the outgoing signal processor 220 may allow for the sidetone generator 205 to generate the sidetones quickly and efficiently, but without compromising on the accuracy of the parameters, which are generated using the higher computational power afforded by the frame-based processing in the outgoing signal processor 220. In some implementations, the cooperative use of the sidetone generator 205 and the outgoing signal processor 220 may reduce the computational burden on the sidetone generator. For example, in implementations where the NLMS ratio 250 is obtained from the outgoing signal processor, the mixer 235 generates an output based on multiplication and addition operations only, whereas the relatively complex operations of generating the NLMS ratio 250 is performed by the outgoing signal processor 220. Because the frame-based processing in the outgoing signal processor 220 involves delays due to buffering, the value of the ratio 250, as obtained from the outgoing signal processor 220, may be one that is calculated based on older samples. However, because the ratio 250 is often not fast-changing, the effect of using a ratio value based on older samples may not be significant.

In some implementations, the output of the mixer 235 is provided to an equalizer 240, which applies an equalization process on the mixer output to generate the sidetone signal. The equalization process can be configured to shape the sidetone signal such that any acoustic feedback generated based on the sidetone signal sounds natural to the user of the headset. In some implementations, the sidetone signal is mixed in with the incoming signal 255, and played back through the acoustic transducers or speakers 215 of the headset. In some implementations, the mixing can include a rate conversion (performed by the sample rate converter 225) to adjust the sample rate to a value appropriate for processing by the speakers 215.

Figure 3:
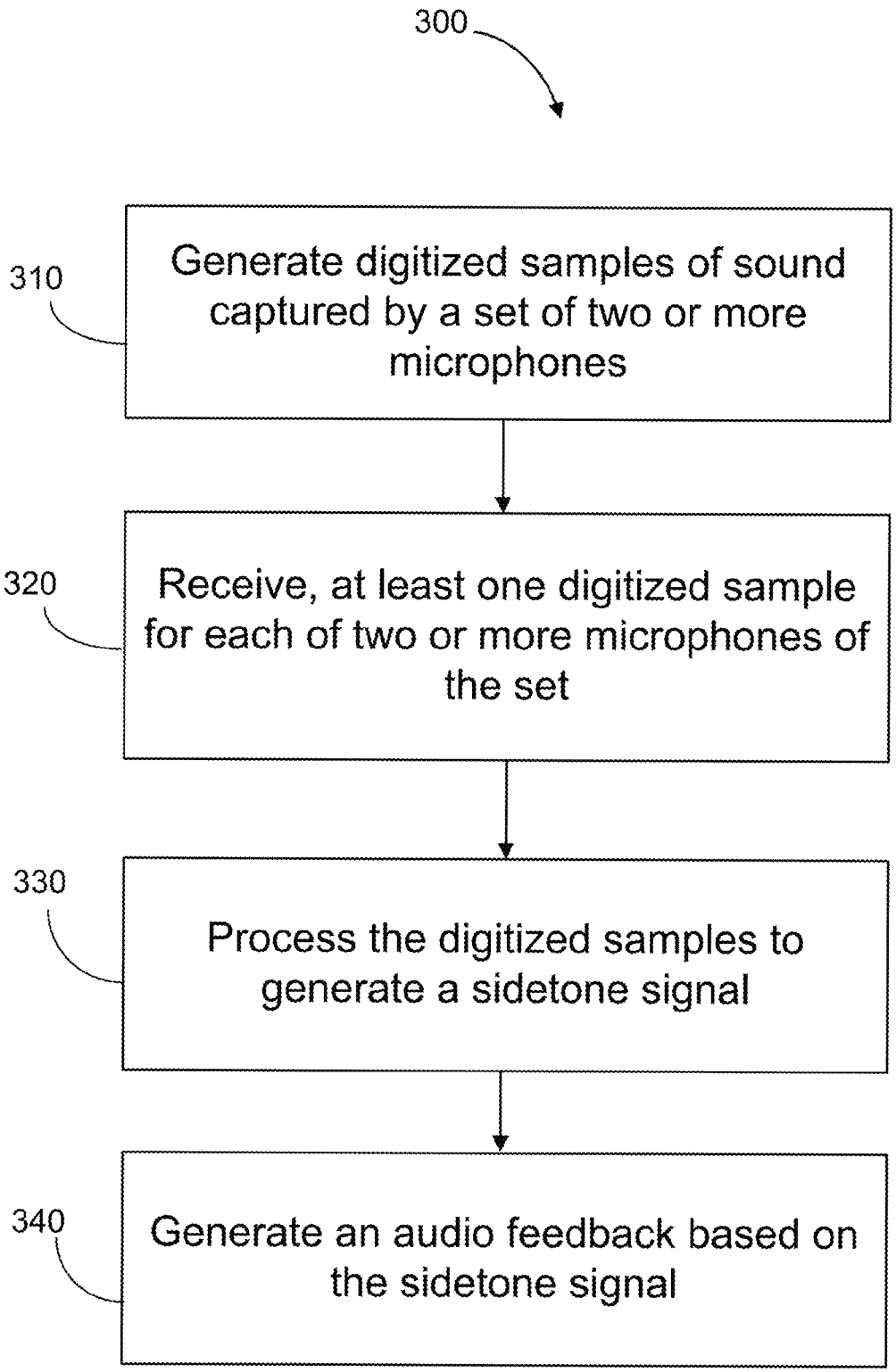
FIG. 3 is a flow chart of an example process for generating a sidetone signal.

FIG. 3 is a flow chart of an example process 300 for generating a sidetone signal. In some implementations, at least a portion of the process 300 can be executed on a headset, for example, by the sidetone generator 205 described above with reference to FIG. 2. Operations of the process 300 can include generating digitized samples of sound captured by a set of two or more microphones (310). The set of microphones can be disposed on a headset such as the headset depicted in FIG. 1. In some implementations, the set of microphones can include three or more microphones. The microphones may be disposed on the headset in the configuration of a phased sensor array.

The operations of the process 300 also include receiving, at one or more processing devices, at least one digitized sample for each of two or more microphones of the set (320). The digitized samples may also in parallel be buffered in a memory device as one or more frames. Such frames may then be processed for subsequent transmission from the headset. In some implementations, the one or more processing devices are configured to receive a set of multiple digitized samples for each of the two or more microphones of the set. A number of digitized samples in each set of multiple digitized samples can be based on, for example, a target latency associated with generating a sidetone signal based on the samples.

Operations of the process further include processing the digitized samples to generate a sidetone signal (330). In some implementations, processing the digitized samples includes executing a beamforming operation using samples from the set of two or more microphones. The beamforming operations can be substantially similar to that described with reference to the beamformer 230 of FIG. 2. In some implementations, processing the digitized samples can include executing a microphone mixing operation using samples from the set of two or more microphones. The microphone mixing operation may be performed, for example, on the beamformed signal, as described above with reference to FIG. 2. In some implementations, the microphone mixing operation can be substantially similar to that described in U.S. Pat. No. 8,620,650, the entire content of which is incorporated herein by reference. In some implementations, processing the digitized samples can include executing an equalization operation.

The operations of the process 300 can also include generating audio feedback based on the sidetone signal (340). The sidetone signal and/or the audio feedback may be generated in parallel with the buffering of the one or more frames of the digitized samples. In some implementations, the sidetone signal and/or the acoustic feedback may be generated within 5 ms (e.g., in 3 ms or 4 ms) of receiving the first of the at least one digitized sample for each of two or more microphones of the set. Such fast sidetone and/or acoustic feedback generation based on stream-based processing of a small number of input samples (e.g., a subset of the samples buffered for frame-based processing) may reduce undesirable acoustic effects typically associated with increased latency, and contribute towards increasing the naturalness of a conversation or speech to a user of headset.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a DSP, a microcontroller, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed one or more processing devices at one site or distributed across multiple sites and interconnected by a network.

Actions associated with implementing all or part of the functions can be performed by one or more programmable processors or processing devices executing one or more computer programs to perform the functions of the processes described herein. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

A number of implementations have been described. However, other embodiments not specifically described in details are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein. While this invention has been particularly shown and described with references to preferred embodiments thereof, it will be understood by those skilled in the art that various changes in form and details may be made therein without departing from the spirit and scope of the invention, as defined by the appended claims.

What is claimed is:

1. An apparatus comprising:

an input device comprising a set of two or more microphones, the input device configured to produce digitized samples of sound captured by the set of two or more microphones;

memory for buffering one or more frames of the digitized samples of the sound captured by the set of two or more microphones;

circuitry for processing the one or more frames of the digitized samples for subsequent transmission;

a sidetone generator comprising one or more processing devices, the sidetone generator configured to:

receive a first number of the digitized samples for each of two or more microphones of the set, wherein the first number is smaller than a second number of the digitized samples in the one or more frames, and process the first number of digitized samples to generate a sidetone signal, wherein the sidetone signal is generated based on one or more parameters provided by the circuitry for processing the one or more frames of the digitized samples; and an acoustic transducer configured to generate an audio feedback based on the sidetone signal.

2. The apparatus of claim 1, wherein the sidetone generator is configured to generate the sidetone signal in parallel with the buffering of the one or more frames of the digitized samples.

3. The apparatus of claim 1, wherein the first number is based on a target latency associated with generating the sidetone signal.

4. The apparatus of claim 1, wherein processing the first number of digitized samples comprises executing a beamforming operation using samples from the set of two or more microphones.

5. The apparatus of claim 4, wherein the one or more parameters comprises one or more beamforming coefficients used in the beamforming operation.

6. The apparatus of claim 1, wherein processing the first number of digitized samples comprises executing a microphone mixing operation using samples from the set of two or more microphones.

7. The apparatus of claim 6, wherein the one or more parameters comprises a mixing ratio associated with a filter used in the mixing operation.

8. The apparatus of claim 1, wherein processing the first number of digitized samples comprises executing an equalization operation.

9. The apparatus of claim 1, wherein the sidetone generator is configured to generate the sidetone signal within 5 ms of receiving the at least one digitized sample for each of two or more microphones of the set.

10. A method comprising:

generating digitized samples of sound captured by a set of two or more microphones;

buffering, in memory, one or more frames of the digitized samples;

generating, using circuitry for processing the one or more frames of the digitized samples, a communication signal for subsequent transmission;

receiving, at one or more processing devices, a first number of the digitized samples for each of two or more microphones of the set, wherein the first number is smaller than a second number of the digitized samples in the one or more frames;

processing the first number of digitized samples to generate a sidetone signal, wherein the sidetone signal is generated based on one or more parameters provided by the circuitry for processing the one or more frames of the digitized samples; and generating audio feedback based on the sidetone signal.

11. The method of claim 10, wherein the sidetone signal is generated in parallel with the buffering of the one or more frames of the digitized samples.

12. The method of claim 10, wherein the first number is based on a target latency associated with generating the sidetone signal.

13. The method of claim 10, wherein processing the first number of digitized samples comprises executing a beamforming operation using samples from the set of two or more microphones.

14. The method of claim 13, wherein the one or more parameters comprises one or more beamforming coefficients used in the beamforming operation.

15. The method of claim 10, wherein processing the first number of digitized samples comprises executing a microphone mixing operation using samples from the set of two or more microphones.

16. The method of claim 14, wherein the one or more parameters comprises a mixing ratio associated with a filter used in the mixing operation.

17. The method of claim 10, wherein processing the first number of digitized samples comprises executing an equalization operation.

18. The method of claim 10, wherein the sidetone signal is generated within 5 ms of receiving the at least one digitized sample for each of two or more microphones of the set.

19. One or more non-transitory machine-readable storage devices storing instructions that are executable by one or more processing devices to perform operations comprising:

receiving a first number of digitized samples comprising at least one digitized sample from each of two or more microphones of a set of microphones generating digitized samples of captured sound;

causing a circuitry for processing one or more frames of the digitized samples to generate a communication signal for subsequent transmission, wherein each of the one or more frames buffers a second number of digitized samples, and the first number is smaller than the second number;

processing the first number of digitized samples to generate a sidetone signal, wherein the sidetone signal is generated based on one or more parameters provided by the circuitry for processing the one or more frames of the digitized samples; and causing generation of audio feedback based on the sidetone signal.

* * * * *